US007052007B2

(12) United States Patent
Yang et al.

(10) Patent No.: US 7,052,007 B2
(45) Date of Patent: May 30, 2006

(54) METHOD AND APPARATUS FOR CONTROLLING PAPER PICKUP IN IMAGE FORMING SYSTEM

(75) Inventors: Cheol-Ju Yang, Daegu Metropolitan (KR); Jun-bae Jeon, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 67 days.

(21) Appl. No.: 10/669,703

(22) Filed: Sep. 25, 2003

(65) Prior Publication Data

US 2005/0035526 A1 Feb. 17, 2005

(30) Foreign Application Priority Data

Jul. 11, 2003 (KR) ..... 10-2003-0047413

(51) Int. Cl.
*B65H 5/00* (2006.01)

(52) U.S. Cl. ..... 271/10.02; 271/265.01; 700/213

(58) Field of Classification Search ..... 271/110, 271/265.01, 10.02, 10.03; 700/213, 219, 700/229

See application file for complete search history.

(56) References Cited

U.S. PATENT DOCUMENTS 4,110,032 A * 8/1978 Hubbard et al. ..... 399/18
6,032,944 A * 3/2000 Lee ..... 271/110
6,826,376 B1 * 11/2004 An et al. ..... 399/75
2004/0096233 A1 * 5/2004 An et al. ..... 399/75

FOREIGN PATENT DOCUMENTS

EP 0798124 * 10/1997

* cited by examiner

*Primary Examiner*—Donald P. Walsh
*Assistant Examiner*—Thomas Morrison
(74) *Attorney, Agent, or Firm*—Roylance, Abrams, Berdo & Goodman, L.L.P.

(57) ABSTRACT

Provided is a method and apparatus for controlling paper pickup in an image forming system. The method comprises (a) setting a number of re-attempts of pickup of paper and a number of no-load operations of a transfer belt, respectively, and (b) performing a paper pickup operation repeatedly in accordance with the set number of re-attempts of pickup of paper and the set number of no-load operations of the transfer belt when paper pickup is not successfully performed.

12 Claims, 4 Drawing Sheets

METHOD AND APPARATUS FOR CONTROLLING PAPER PICKUP IN IMAGE FORMING SYSTEM

BACKGROUND OF THE INVENTION

This application claims priority from Korean Patent Application No. 2003-47413, filed on Jul. 11, 2003, in the Korean Intellectual Property Office, the disclosure of which is incorporated herein by reference in its entirety.

1. Field of the Invention

The present invention relates to an image forming system, and more particularly, to a method and apparatus for controlling paper pickup in an image forming system by which the probability of paper jams caused by a pickup error of paper is reduced.

2. Description of the Related Art

In an electrophotographic image forming system, when an exposure unit radiates light onto a photosensitive medium charged to a predetermined potential, an electrostatic latent image is formed on the photosensitive medium. Thereafter, a developing unit forms a toner image by supplying toner to the electrostatic latent image. In general, a color electrophotographic image forming system needs four developing units in which four color toners, such as cyan (C), magenta (M), yellow (Y), and black (B), is stored. The toner image is transferred onto paper directly from the photosensitive medium or via an intermediate transfer medium. When the transferred toner image passes a fusing unit, the toner image is fused on the paper by heat and pressure. A single color or multiple color image is printed on the paper through the above procedure.

The above image forming system sets the number of re-attempts of pickup of paper at a time when a printing operation starts, and performs paper pickup by driving a pickup unit. When paper is not detected by a paper feeding sensor within a predetermined time period from a time when the pickup unit is driven to a time when front end of paper is detected by the paper feeding sensor, it is determined that a pickup error has occurred, and the image forming apparatus performs paper pickup repeatedly. The above paper pickup operation is performed by the set number of re-attempts of pickup of paper. When paper pickup does not occur successfully within the number of re-attempts of pickup of paper, it is determined that a paper jam has occurred, and the image forming system indicates a message representing that a paper jam has occurred, or generates a warning sound.

However, when a printing speed is fast, it is difficult to obtain a time required to re-attempt paper pickup when a pickup error occurs according to mechanical specifications of image forming systems, resulting in that it is difficult to set the number of re-attempts of pickup of paper. As a result, reducing the probability of paper jams by performing a paper pickup operation is not possible.

SUMMARY OF THE INVENTION

The present invention provides a method and apparatus for controlling paper pickup in an image forming system by which a time required to re-attempt paper pickup when a pickup error occurs is obtained by performing a no-load operation of a transfer belt, such that the probability of paper jams caused by a pickup error of paper is reduced, and an image forming system using the method and apparatus.

According to an aspect of the present invention, a method for controlling paper pickup in an image forming system includes (a) setting a number of re-attempts of pickup of paper and a number of no-load operations of a transfer belt, respectively, and (b) performing a paper pickup operation repeatedly in accordance with the number of re-attempts of pickup of paper and the number of no-load operations of the transfer belt set in (a) when paper pickup is not successfully performed.

According to another aspect of the present invention, an apparatus for controlling paper pickup in an image forming system includes a pickup re-attempt condition setting unit, which sets a number of re-attempts of pickup of paper and a number of no-load operations of a transfer belt, respectively. The system further includes a pickup controller, which controls a pickup unit to perform a paper pickup operation repeatedly in accordance with the set number of re-attempts of pickup of paper when the paper is not detected by a paper feeding sensor within a predetermined amount of time from the time when the pickup unit is driven. The pickup controller also controls the pickup unit to perform a no-load operation of the transfer belt and to perform a paper pickup operation repeatedly in accordance with the set number of no-load operations of the transfer belt when paper pickup is not successfully performed within the number of re-attempts of pickup of paper.

According to another aspect of the present invention, an image forming system includes a controller. The controller performs the following operations: sets a number of re-attempts of pickup of paper and a number of no-load operations of a transfer belt, respectively; controls a pickup unit to perform a paper pickup operation repeatedly in accordance with the set number of re-attempts of pickup of paper when the paper is not detected by a paper feeding sensor within a predetermined amount of time from the time when the pickup unit is driven; controls the pickup unit to perform a no-load operation of the transfer belt and to perform a paper pickup operation repeatedly in accordance with the set number of no-load operations of the transfer belt when paper pickup is not successfully performed within the number of re-attempts of pickup of paper; and determines that a paper jam occurs due to a pickup error when paper pickup is not successfully performed within the number of no-load operations of the transfer belt.

According to another aspect of the present invention, the method may be implemented using a computer readable medium on which a program for executing the method in a computer is recorded.

BRIEF DESCRIPTION OF THE DRAWINGS

The above and other aspects and advantages of the present invention will become more apparent by describing in detail preferred embodiments thereof with reference to the attached drawing figures in which.

In the drawing figures, it will be understood that like numerals refer to like features and structures.

DETAILED DESCRIPTION OF THE INVENTION

Hereinafter, preferred embodiments of the present invention will be described in detail with reference to the accompanying drawing figures.

Figure 1:
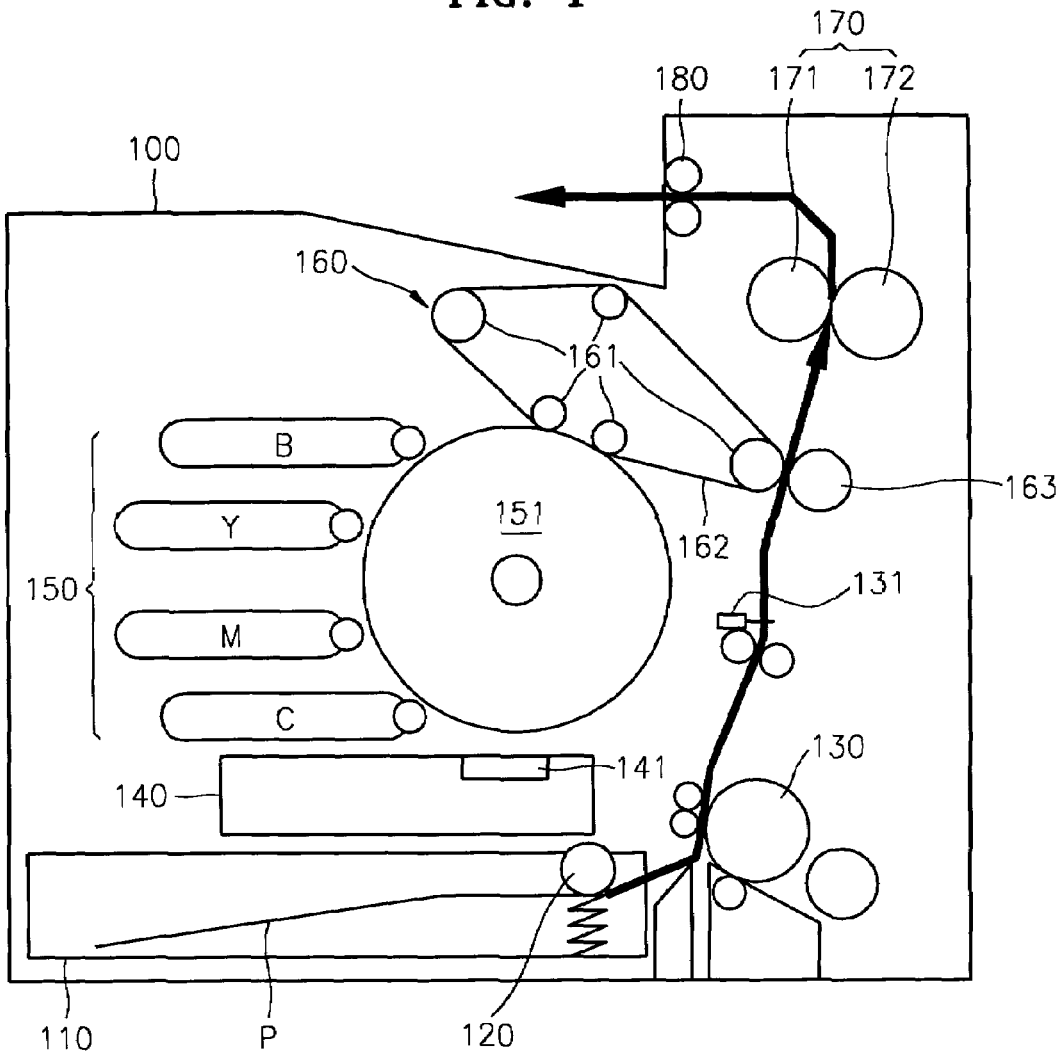
FIG. 1 is a side cross-sectional view illustrating a mechanism of an image forming system using a method for controlling paper pickup in an image forming system, according to an embodiment of the present invention.

FIG. 1 is a side cross-sectional view illustrating a mechanism of an image forming system using a method for controlling paper pickup in an image forming system, according to an embodiment of the present invention. The image forming system includes a stacking unit 110, a pickup unit 120, a paper feeding unit 130, an exposure unit 140, a developing unit 150, a transfer unit 160, a fusing unit 170, and a paper exhausting unit 180.

Referring to FIG. 1, the stacking unit 110, generally a cassette, is installed in a lower portion of a main body 100, to be attached to or detached from the main body 100, and paper P is stacked therein. The paper P is picked-up by the pickup unit 120, which is rotatably installed in the main body 100, and transferred inside the main body 100 generally in the direction of the arrow.

The pickup unit 120, generally a pickup roller, picks up the paper P from the stacking unit 110. The paper feeding unit 130, generally a paper feeding roller, transfers the paper P picked-up from the stacking unit 110 inside the main body 100. A paper feeding sensor 131 detects a front end of the paper P and senses whether pickup of the paper P from the stacking unit 110 is successfully performed by the pickup unit 120 according to a detection result of the front end of the paper P.

The exposure unit 140 radiates light corresponding to an image signal on a photosensitive drum 151 charged to have a uniform potential to form an electrostatic latent image. In general, the exposure unit 140 is a laser scanning unit (LSU) using a laser diode as a light source. In this case, a light window 141 is opposite to the photosensitive drum 151. A laser beam from the laser diode is radiated through light window 141 onto photosensitive drum 151.

The developing unit 150 comprises a plurality of ink cartridges adapted to contact the photosensitive drum 151 so as to develop the electrostatic latent image formed on the surface of the photosensitive drum 151 by the exposure unit 140, as a predetermined color image, in response to the image signal. A developing agent stored in the plurality of ink cartridges is used to form a predetermined visible image on the electrostatic latent image formed on the photosensitive drum 151.

The transfer unit 160 includes a transfer belt 162, which is supported by a plurality of transfer belt backup rollers 161 and rotated in a closed loop and on which the toner image formed on the surface of the photosensitive drum 151 is transferred. The transfer unit 160 further includes a transfer roller 163, which is installed to be opposite to one of the plurality of transfer belt backup rollers 161. The transfer belt 162 is placed between the plurality of transfer belt backup rollers 161 and the transfer roller 163, and presses the paper P toward the transfer belt 162. Thus, a color toner image transferred from the photosensitive drum 151 to the transfer belt 162 is transferred onto the paper P. The traveling linear velocity of the transfer belt 162 is preferably the same as a rotation linear velocity of the photosensitive drum 151. In addition, the length of the transfer belt 162 is preferably the same as or at least longer than the length of the paper P in which the color toner image is finally received.

In the transfer unit 160, the transfer roller 163 is installed to be opposite to the transfer belt 162. The transfer roller 163 is separated from the transfer belt 162 by a solenoid (not shown) while the color toner image is transferred to the transfer belt 162. Driving the transfer belt 162 while the transfer belt 162 is separated from the transfer roller 163 is considered to be a no-load operation of the transfer belt 162. When the color toner image is completely transferred to the transfer belt 162, the transfer roller 163 contacts the transfer belt 162 at a predetermined pressure, so 25 as to transfer the color toner image onto the paper P.

The fusing unit 170 includes a fusing roller 171 which generates heat, and a pressing roller 172 which is installed opposite the fusing roller 171. The paper P is placed between the fusing roller 171 and the pressing roller 172, which presses the paper P toward the fusing roller 171. The fusing roller 171 heats the paper P in which the visible image is formed, and fuses the visible image onto the paper P.

The paper exhausting unit 180, generally a paper exhausting roller, exhausts the paper P in which the visible image is formed to outside. In order to perform printing on both sides, the paper exhausting unit 180 is reversed. As such, the paper P is reversely rotated and transferred to a reversal path.

Figure 2:
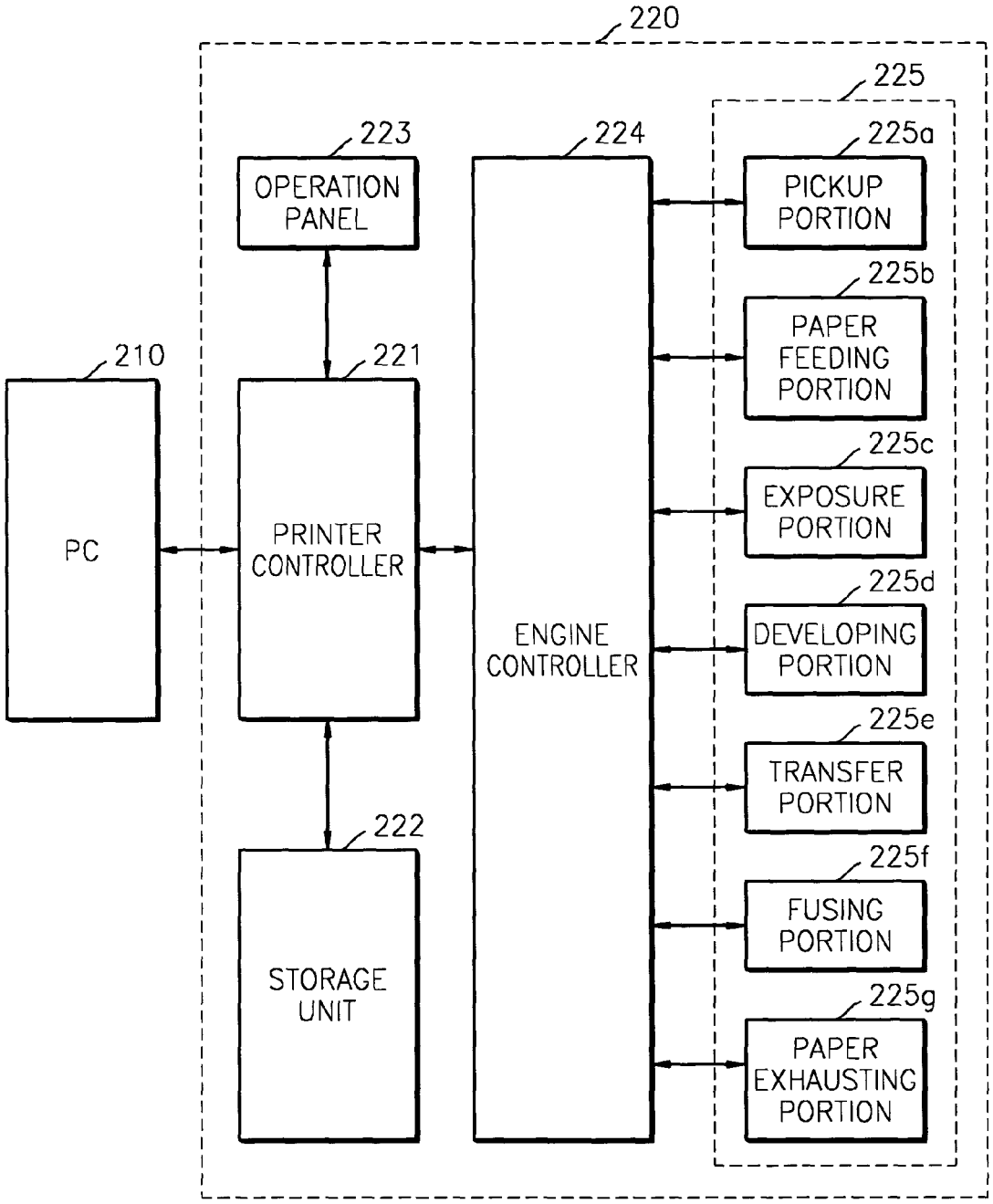
FIG. 2 is a functional block diagram illustrating a function of the image forming system for performing the method for controlling paper pickup, according to an embodiment of the present invention.

FIG. 2 is a functional block diagram illustrating a function of an image forming system 220 for performing the method for controlling paper pickup, according to the present invention. The image forming system 220 includes a printer controller 221, a storage unit 222, an operation panel 223, an engine controller 224, and an engine unit 225.

Referring to FIG. 2, the printer controller 221 converts a printing data received from outside, e.g., from a computer (PC) 210 connected to a communication interface into an image data appropriate for driving the engine unit 225 according to printing conditions set in a printer driver (not shown) and stores the image data in the storage unit 222.

The storage unit 222 stores various control programs required to implement the function of the image forming system 220, various data generated in the printer controller 221 by performing the control programs, the printing data received from the PC 210, and printing information temporarily.

The operation panel 223 includes a key matrix and a display. The key matrix generates data according to keys pressed by a user to designate each mode and to perform an operation in a designated mode, and outputs the data to the printer controller 221. The display displays the operational state of the system when the printer controller 221 executes each mode.

The engine controller 224 controls the engine unit 225 so that an image corresponding to the image data received from the printer controller 221 is printed on the paper P. For this purpose, when a printing instruction command is received from the printer controller 221, the engine controller 224 controls the engine unit 225 so that each of portions 225*a*–225*g* of the engine unit 225 is prepared to perform a printing operation. An example of printing operation preparation is to rotate a polygonal rotating mirror or a scan disc which is a deflection means of an exposure portion 225*c*, at a predetermined speed required during the printing operation, or to heat a fusing portion 225*f* to a predetermined temperature, or to check whether something is wrong with each device that performs the printing operation.

Thus, after the printing instruction command is received from the printer controller 221, when it is determined that the printing operation can be performed after a printing preparation time, the engine controller 224 controls the engine unit 225 to apply a printing starting signal to the printer controller 221 and to supply an image data stored in the storage unit 222 to the exposure portion 225*c* via the engine controller 224.

The engine unit 225 includes various portions required for the printing operation. For example, in the case of electrophotographic image forming system, the engine unit 225 includes a pickup portion 225*a*, a paper feeding portion 225*b*, an exposure portion 225*c*, a developing portion 225*e*, a fusing portion 225*f*, and a paper exhausting portion 225*g*, as shown in FIG. 2. In this way, the engine unit 225 may be formed in various shapes according to a printing method.

Figure 3:
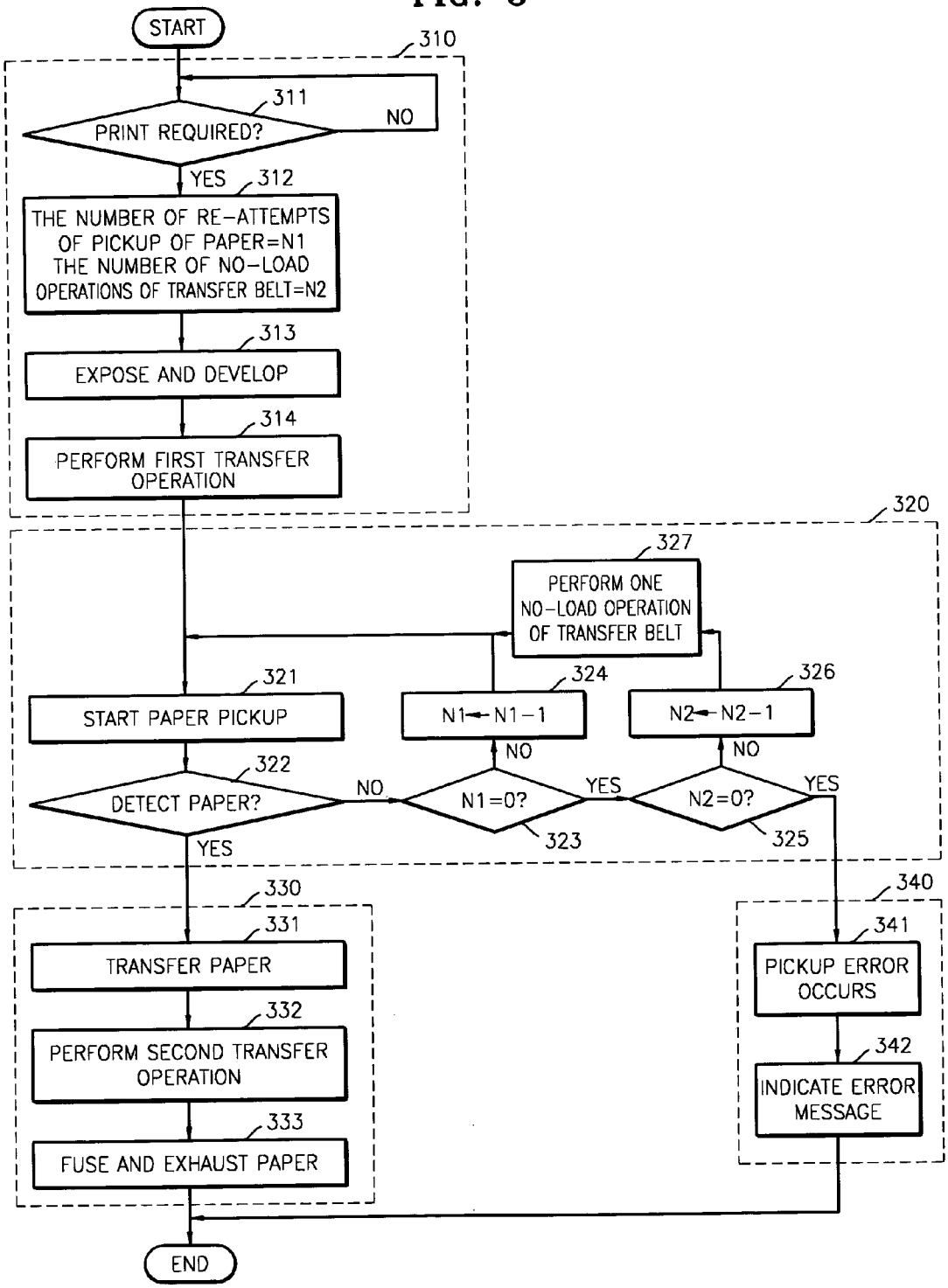
FIG. 3 is a flowchart illustrating a method for controlling paper pickup in an image forming system, according to an embodiment of the present invention.

FIG. 3 is a flowchart illustrating a method for controlling paper pickup in an image forming system, according to an embodiment of the present invention. The method for controlling paper pickup comprises steps 310 through 340, and will be described with reference to FIGS. 1 and 2. Preferably, steps 310 through 340 are programmed as code segments performed in the printer controller 221 or an additional processor.

Referring to FIG. 3, in step 310, the number of re-attempts of pickup of paper and the number of no-load operations of a transfer belt are respectively set at a time when a printing operation starts. For this purpose, in step 311, whether a command to print is given from the PC 210 is monitored.

In step 312, when the command to print is given as a monitoring result of step 311, the number of re-attempts of pickup of paper and the number of no-load operations of a transfer belt are set to N1 and N2, respectively. Here, preferably, N1 is set to an integer number, which is the same as or smaller than a value obtained by dividing a time period from the time when the printing operation starts to a time when the transfer roller 163 contacts the transfer belt 162 and a toner image of the transfer belt 162 is transferred onto paper, by a time period corresponding to a time when the pickup unit 120 is driven to a time when a front end of the paper is detected in the transfer roller 163. Preferably, N2 is set to an integer number, which is the same as or smaller than a value obtained by dividing a time period from the time when the printing operation starts to a time when a color toner image is transferred to the transfer belt 162 by a developing agent stored in a plurality of ink cartridges, by a time period in which one no-load operation of the transfer belt 162 is performed.

In step 313, a toner image is formed with the developing agent stored in the plurality of ink cartridges on an electrostatic latent image formed on the surface of the photosensitive drum 151 by the exposure unit 140 in response to an image signal. In step 314, a first transfer operation of transferring the toner image formed on the surface of the photosensitive drum 151 to the transfer belt 162 which is supported by the plurality of transfer belt backup rollers 161 and rotated, is performed. The first transfer operation is repeatedly performed on each color such that a superimposed image is formed on the transfer belt.

In step 320, a paper pickup operation is performed according to the number of re-attempts of pickup of paper and the number of no-load operations of the transfer belt set in step 312, and whether a paper jam occurs due to a pickup error is determined. For this purpose, in step 321, the pickup unit 120 is driven, and pickup of the paper stacked in the tray of the stacking unit 110 starts. In step 322, whether the paper is detected by the paper feeding sensor 131 within a predetermined time period from the time when the pickup unit 120 is driven to a time when a front end of the paper is detected by the paper feeding sensor 131, is determined.

If the paper is not detected by the paper feeding sensor 131, whether the number N1 of re-attempts of pickup of paper is '0' is determined in step 323. As a result of determination of step 323, when the number of re-attempts of pickup of paper is not '0', in step 324, the number N1 of re-attempts of pickup of paper is reduced by '1'. Then, the method returns to step 321, and the paper pickup operation is repeatedly performed. Meanwhile, as a determination result of step 323, when the number N1 of re-attempts of pickup of paper is '0', whether the number N2 of no-load operations of the transfer belt is '0' is determined in step 325. As a determination result of step 325, when the number N2 of no-load operations of the transfer belt 162 is not '0', the number N2 of no-load operations of the transfer belt 162 is reduced by '1' in step 326. In step 327, one no-load operation of the transfer belt 162 is performed. Then, the method returns to step 321 and the paper pickup operation is repeatedly performed. Through the above operation, even though paper pickup is not successfully performed within the number N1 of re-attempts of pickup of paper, the time required for one no-load operation of the transfer belt 162 is obtained. Thus, a significant reduction in printing speed is avoided, and the paper pickup operation can be repeatedly performed.

In step 330, when paper pickup is successfully performed according to the number N1 of re-attempts of pickup of paper and the number N2 of no-load operations of the transfer belt 162 set in step 312, other procedures of the printing operation are performed. For this purpose, in step 331, as a determination result of step 322, when the paper is detected by the paper feeding sensor 131, the paper is transferred to the transfer roller 163 through a predetermined transfer path. In step 332, when the front end of the paper is detected in the transfer roller 163, a second transfer operation of the transfer belt 162 contacting the transfer roller 163 at a predetermined pressure and transferring the color toner image transferred to the transfer belt 162 onto the paper, is performed. In step 333, a fusing operation of fusing a visible image on the paper by heating the paper in which a visible image is formed is performed using the fusing unit 170, and a paper exhaustion operation of exhausting the paper on which the visible image is fused to outside is performed using the paper exhaustion unit 180.

In step 340, when paper pickup is not successfully performed according to the number N1 of re-attempts of pickup of paper and the number N2 of no-load operations of the transfer belt 162 set in step 312, it is determined that the paper jam occurred due to a pickup error, and a procedure thereof is performed. For this purpose, in step 341, as a determination result of step 325, when the number N2 of no-load operations of the transfer belt 162 is '0', it is determined that the paper jam occurred due to a pickup error. In step 342, an error message representing that the paper jam has occurred, is indicated, or a warning sound is generated.

Figure 4:
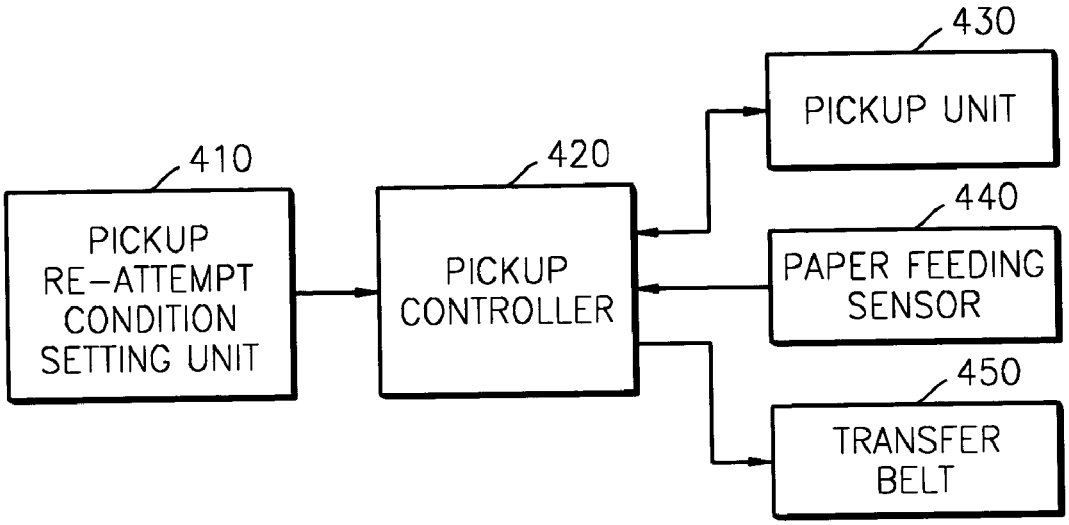
FIG. 4 is a block diagram illustrating a structure of an apparatus for controlling paper pickup in an image forming system, according to an embodiment of the present invention.

FIG. 4 is a block diagram illustrating the structure of an apparatus for controlling paper pickup, according to an embodiment of the present invention. The apparatus for controlling paper pickup up includes a pickup re-attempt condition setting unit 410 and a pickup controller 420.

Referring to FIG. 4, when the command to print is received from a PC (210 of FIG. 2), the pickup re-attempt condition setting unit 410 sets pickup re-attempt conditions, such as the number N1 of re-attempts of pickup of paper and the number N2 of no-load operations of a transfer belt.

If a predetermined time to prepare printing has been elapsed after the command to print is received, when paper is not detected by the paper feeding sensor 440 within a predetermined amount of time from a time when the pickup unit 430 is driven, the pickup controller 420 controls the pickup unit 430 to perform a paper pickup operation repeatedly in accordance with the set number N1 of re-attempts of pickup of paper. When paper pickup is not successfully performed within the number N1 of re-attempts of pickup of paper, the pickup controller 420 controls the pickup unit 430 to perform a no-operation of a transfer belt 450 in accordance with the set number N2 of no-load operations of the transfer belt and to perform the paper pickup operation repeatedly.

The present invention may be implemented as a computer readable code on a computer readable medium. The computer readable medium includes all types of recording devices on which data that can be read by a computer system are stored, such as ROMs, RAMs, CD-ROMs, magnetic tapes, floppy discs, optical data storage units, and carrier waves (for example, transmission via the Internet). Also, the computer readable medium can be distributed over a network-connected computer system and can be stored and executed as computer readable codes. Functional programs, codes, and code segments for implementing the present invention may be easily inferred by programmers in the field of technology to which the present invention belongs.

As described above, according to the present invention, the time required to re-attempt paper pickup when a pickup error occurs is obtained by performing a no-load operation of a transfer belt regardless of mechanical specifications of image forming systems, such that reduction in a printing speed is minimized and the probability of paper jams caused by a pickup error of paper is reduced.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. A method for controlling paper pickup in an image forming system, the method comprising:

(a) setting a number of re-attempts of pickup of paper and a number of no-load operations of a transfer belt, respectively; and (b) performing a paper pickup operation repeatedly in accordance with the number of re-attempts of pickup of paper and the number of no-load operations of the transfer belt when paper pickup is not successfully performed.

2. The method of claim 1, wherein the number of re-attempts of pickup of paper is set to an integer number, which is the same as or smaller than a value obtained by dividing a time period from a time when a printing operation starts to a time when a transfer roller contacts the transfer belt and a toner image of the transfer belt is transferred onto paper, by a time period from a time when a pickup unit is driven to a time when a front end of a sheet of paper is detected in the transfer roller.

3. The method of claim 1, wherein the number of no-load operations of the transfer belt is set to an integer number, which is the same as or smaller than a value obtained by dividing a time period from a first time when a printing operation starts to a second time when a color toner image is transferred to the transfer belt by a developing agent stored in a plurality of ink cartridges, by a time period in which one no-load operation of the transfer belt is performed.

4. The method of claim 1, wherein the step of performing a paper pickup operation further comprises:

(b1) performing a paper pickup operation repeatedly in accordance with the set number of re-attempts of pickup of paper when a sheet of paper is not detected by a paper feeding sensor within a predetermined amount of time from a time when a pickup unit is driven; and (b2) performing a no-load operation of the transfer belt and performing the paper pickup operation repeatedly in accordance with the set number of no-load operations of the transfer belt when paper pickup is not successfully performed within the number of re-attempts of pickup of paper.

5. The method of claim 4, wherein the step of performing the paper pickup operation further comprises (b3) determining that a paper jam occurs due to a pickup error when paper pickup is not successfully performed within the number of no-load operations of the transfer belt.

6. A computer readable medium of instructions for controlling paper pickup in an image forming system comprising:

a first set of instructions for controlling the image forming system to set a number of re-attempts of pickup of paper and a number of no-load operations of a transfer belt, respectively; and a second set of instructions for controlling the image forming system to perform a paper pickup operation repeatedly in accordance with the number of re-attempts of pickup of paper and the number of no-load operations of the transfer belt when paper pickup is not successfully performed.

7. The computer readable medium of instructions of claim 6, further comprising:

a third set of instructions for controlling the image forming system to perform the paper pickup operation repeatedly in accordance with the set number of re-attempts of pickup of paper when a sheet of paper is not detected by a paper feeding sensor within a predetermined amount of time from a time when a pickup unit is driven; and a fourth set of instructions for controlling the image forming system to perform a no-load operation of the transfer belt and perform the paper pickup operation repeatedly in accordance with the set number of no-load operations of the transfer belt when paper pickup is not successfully performed within the number of re-attempts of pickup of paper.

8. An apparatus for controlling paper pickup in an image forming system, the apparatus comprising:

a pickup unit for performing a paper pickup operation to pickup a sheet of paper from a stacking unit;

a paper feeding sensor for sensing whether the paper pickup operation has been successfully performed;

a transfer unit for performing a no-load operation of a transfer belt;

a pickup re-attempt condition setting unit, which sets a number of re-attempts of pickup of paper and a number of no-load operations of the transfer belt, respectively; and a pickup controller, which controls the pickup unit to perform the paper pickup operation repeatedly in accordance with the set number of re-attempts of pickup of paper when the sheet of paper is not detected by the paper feeding sensor within a predetermined amount of time from a time when the pickup unit is driven, controls the transfer unit to perform a no-load operation of the transfer belt when paper pickup is not successfully performed within the set number of re-attempts of pickup of paper, and further controls the pickup unit to perform a paper pickup operation repeatedly in accordance with the set number of no-load operations of the transfer belt when paper pickup is not successfully performed within the set number of re-attempts of pickup of paper.

9. The apparatus of claim 8, wherein when paper pickup is not successfully performed within the set number of no-load operations of the transfer belt, the pickup controller determines that a paper jam occurs due to a pickup error.

10. The apparatus of claim 8, wherein the number of re-attempts of pickup of paper is set to an integer number, which is the same as or smaller than a value obtained by dividing a time period from a time when a printing operation starts to a time when a transfer roller contacts the transfer belt and a toner image of the transfer belt is transferred onto paper, by a time period from a time when a pickup unit is driven to a time when a front end of the paper is detected by the paper feeding sensor.

11. The apparatus of claim 8, wherein the number of no-load operations of the transfer belt is set to an integer number, which is the same as or smaller than a value obtained by dividing a time period from the time when a printing operation starts to a time when a color toner image is transferred to the transfer belt by a developing agent stored in a plurality of ink cartridges, by a time period in which one no-load operation of the transfer belt is performed.

12. An image forming system comprising a pickup unit for performing a paper pickup operation to pickup a sheet of paper from a stacking unit, a paper feeding sensor for detecting a successful paper pickup operation, a transfer unit for performing a no-load operation of a transfer belt, and a controller, wherein the controller:

sets a number of re-attempts of pickup of paper and a number of no-load operations of a transfer belt, respectively;

controls the pickup unit to perform a paper pickup operation repeatedly in accordance with the set number of re-attempts of pickup of paper when the paper is not detected by the paper feeding sensor within a predetermined amount of time from the time when the pickup unit is driven;

controls the transfer unit to perform a no-load operation of the transfer belt and controls the pickup unit to perform a paper pickup operation repeatedly in accordance with the set number of no-load operations of the transfer belt when paper pickup is not successfully performed within the number of re-attempts of pickup of paper; and determines that a paper jam occurs due to a pickup error when paper pickup is not successfully performed within the number of no-load operations of the transfer belt.

* * * * *